US008356433B2

(12) United States Patent
Babbitt et al.

(10) Patent No.: US 8,356,433 B2
(45) Date of Patent: Jan. 22, 2013

(54) BADGE DISPLAYING DEVICE

(76) Inventors: James Babbitt, Grand Blanc, MI (US); Thomas Michael Cory, Sterling Heights, MI (US)

( * ) Notice: Subject to any disclaimer, the term of this patent is extended or adjusted under 35 U.S.C. 154(b) by 0 days.

(21) Appl. No.: 12/769,243

(22) Filed: Apr. 28, 2010

(65) Prior Publication Data

US 2011/0265355 A1 Nov. 3, 2011

(51) Int. Cl.
*A44C 3/00* (2006.01)

(52) U.S. Cl. ..... 40/1.5; 40/622; 24/114.05; 33/653

(58) Field of Classification Search ..... 40/1.5, 40/622, 605; 24/114.05; 33/653
See application file for complete search history.

(56) References Cited

U.S. PATENT DOCUMENTS

| | | | | | |
|---|---|---|---|---|---|
| 1,413,468 | A | * | 4/1922 | Gaunt | 40/1.5 |
| 2,795,876 | A | * | 6/1957 | Hayes | 40/1.5 |
| 2,995,849 | A | * | 8/1961 | Donnellan | 40/618 |
| 3,376,651 | A | * | 4/1968 | Carey | 33/653 |
| 3,942,273 | A | | 3/1976 | Adams | |
| 4,137,657 | A | * | 2/1979 | Wardle | 40/1.5 |
| 4,591,058 | A | * | 5/1986 | Amstutz et al. | 211/94.01 |
| 4,619,125 | A | * | 10/1986 | Choi | 70/460 |
| 4,698,928 | A | * | 10/1987 | Soporowski | 40/651 |
| 6,050,426 | A | * | 4/2000 | Leurdijk | 211/94.01 |
| 6,122,805 | A | | 9/2000 | Haegley | |
| 7,096,614 | B1 | | 8/2006 | Williams | |
| 2007/0186390 | A1 | | 8/2007 | Johnston | |

* cited by examiner

*Primary Examiner* — Gary Hoge
(74) *Attorney, Agent, or Firm* — Rader, Fishman & Grauer, PLLC

(57) ABSTRACT

A badge displaying device comprising a backing plate having a left and right sides, a center between the left and right sides, and top and bottom surfaces. The backing plate has at least one slot through at least the top surface extending from one of the left or right sides towards the center of the backing plate. A pin clip sized to slide in the at least one slot receives a pin from a badge.

16 Claims, 3 Drawing Sheets

BADGE DISPLAYING DEVICE

BACKGROUND OF THE INVENTION

The present invention relates to an apparatus for attaching items to apparel and more particularly for attaching medals and ribbons on a uniform.

Awards and ribbons are awarded to military personnel as well as policeman, fireman, and others for certain distinguished activities. Regulations dictate how and where these medals and ribbons are to be worn on a uniform which may either be a shirt or a jacket. If a user has many medals and ribbons, placing them on a uniform can be a time consuming task. The military has extensive regulations have strict requirements about the alignment and placement of the medals on uniforms and relative to each other.

One device used to assist users to align their badges and medals is disclosed in U.S. Pat. No. 7,325,339 to Jordan. The invention comprises of a flat back plate having a multitude of slots formed therein. The user inserts the pins of the medal or ribbon through the slots and secures the medal or ribbon using a fastener as is well known in the art. The plate has breakaway portions such that the user may end up buying more plate than is necessary for his medals and ribbons and break off the unnecessary portion. Once the plate is broken away, and the user requires additional space to attach additional medals, the user must buy a whole new plate. Additionally, the fastener may be pressed into the body of the user creating an uncomfortable sensation.

Accordingly, there is a need for apparatus that can quickly and accurately allow a user to mount medals and ribbons onto a uniform that allows for easy expansion when needed and not have fasteners pressing into the body.

BRIEF SUMMARY OF THE INVENTION

The present invention is directed to a badge displaying device having a backing plate having a left and right sides, a center between the left and right sides, and top and bottom surfaces. The backing plate has at least one slot through at least the top surface extending from one of the left or right sides towards the center of the backing plate. A pin clip sized to slide in the at least one slot is provided to secure the badge.

Another embodiment of the present invention is directed to a badge displaying device for displaying medals or ribbons, the badge displaying device having a backing plate having a left and right sides, a center between the left and right sides, and top and bottom surfaces. The backing plate has two slots through at least the top surface extending respectively from the left and right sides towards the center of the backing plate. Two pin clips sized to slide into the slots are provided to secure the badge. The pin clip has a body portion and a receiving portion.

Yet another embodiment of the present invention is directed to a badge displaying system having a first backing plate having up and down sides, left and right sides and top and bottom surfaces. The backing plate has at least one slot through at least the top surface extending from a side towards the center of the backing plate and a pin clip sized to slide in the slot. The backing plate has one of a protrusion extending outwardly or crevice extending inwardly from the down side. The system also has a second plate having up and down sides, left and right sides and top and bottom surfaces. This backing plate has at least one slot through at least the top surface extending from a side towards the center of the backing plate and a pin clip sized to slide in the slot. This backing plate has one of a protrusion extending outwardly or crevice extending inwardly from the up side sized to receive the one of a protrusion extending outwardly or crevice extending inwardly from the down side of the first backing plate such that the first and second backing plates are retained together.

DETAILED DESCRIPTION OF THE INVENTION

Figure 1:
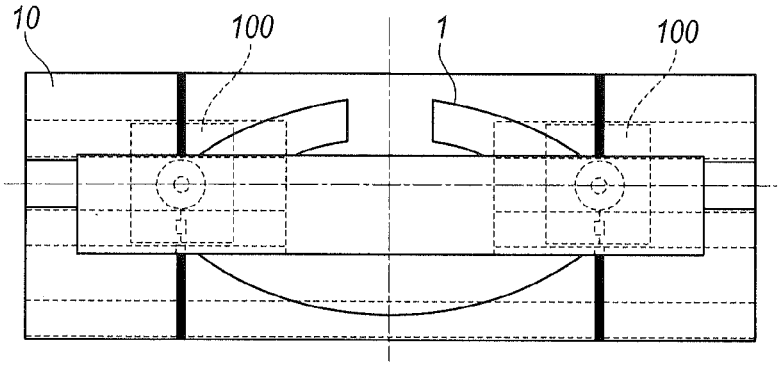
FIG. 1 is a top view of a badge displaying device of the present invention with a badge.
Figure 2:
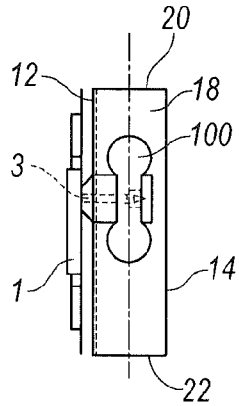
FIG. 2 is a right side view of a badge displaying device of the present invention with a badge.

Referring now to FIGS. 1 to 10, a badge displaying device 5 is shown comprising a backing plate 10 and at least one pin clip 100. The badge 1 is shown having a securing pin 3. Typically, the pin 3 is inserted through material and a fastener (not shown) is used to secure the badge 1. Badge is herein defined as any medal, ribbon, or other item to be worn by a user that needs to be secured to a uniform or garment.

The badge displaying device 5 includes a backing plate 10 comprises a top surface 12, a bottom surface 14, left side 16, right side 18, top side 20, and bottom side 22. The backing plate also comprises alignment features 24 which may be either raised surfaces, indentations, or other markings made during the manufacturing process or created afterwards. The backing plate 10 may also include indicia (nor shown) used to help identify the type of badge to be attached and the particular position. For example, two popular badges are the Air Assault badge and the Combat Infantry badge. The backing plate 10 may also include indicia or markings to assist the user to properly locate the backing plate 10 relative to the uniform. These indicia or markings may be either raised surfaces, indentations, or other markings made during the manufacturing process or created afterwards. Such indicia or markings could be the alignment features 24 described above, or other features.

The backing plate 10 can be manufactured out of nearly any type of material and process but is preferably injection molded out of a thermoplastic rubber such as Santoprene® by Advanced Elastomer Systems.

Figure 4:
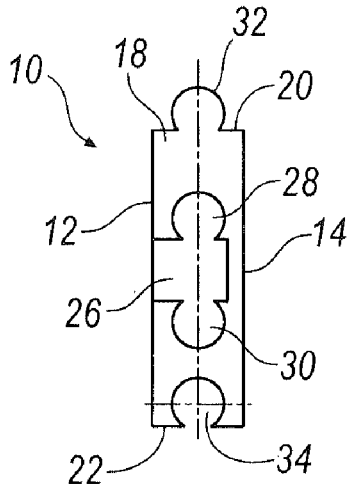
FIG. 4 is a right side view of a second embodiment of a backing plate of the present invention.
Figure 4A:
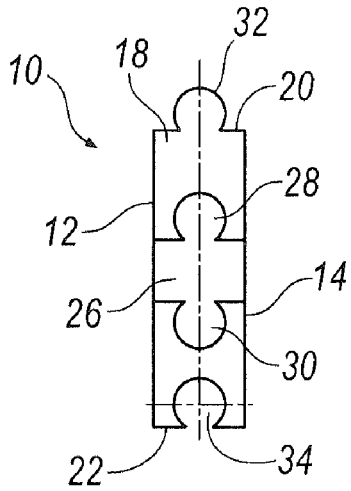
FIG. 4A is an alternate embodiment of the present invention.
Figure 5:
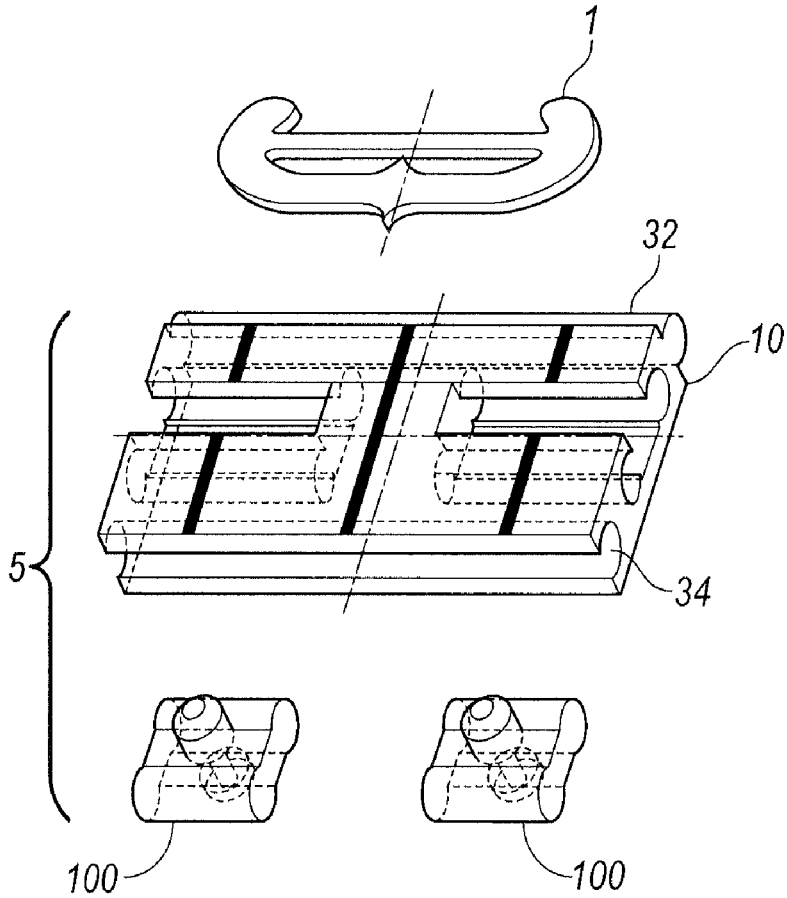
FIG. 5 is an exploded view of a badge displaying device of the present invention and badge.

The backing plate 10 has at least one slot 26 coming from either the left or right sides 16, 18, respectively, towards the center 17. The slots 26 sized to receive the pin clip 100. In the illustrations, the backing plate contains 2 slots 26 one coming from the left 16 and one coming from the right side 18, both towards the center 17. In the illustrations, the slot 26 is shown as only penetrating the top surface 12. However, in practice the slot 26 may penetrate the bottom surface 14 as well as shown in FIG. 4A.

The slot 26 is sized to receive the pin clip 100. In the illustrations, the slot 26 is shown having crevices 28, 30 between the top and bottom surfaces 12, 14 extending towards the top and bottom sides 20, 22.

The backing plate 10 may also have a protrusion 32 extending outwardly from either the top or bottom sides 20, 22, a crevice 34 extending inwardly from either the top or bottom side 20, 22, just a flat top or bottom side 20, 22. The protrusion 32 is shown as a bulbous shape corresponding to the crevice 34. The protrusion 32 and crevice 34 can have any shape so long as they are able to mate with each other.

Figure 3:
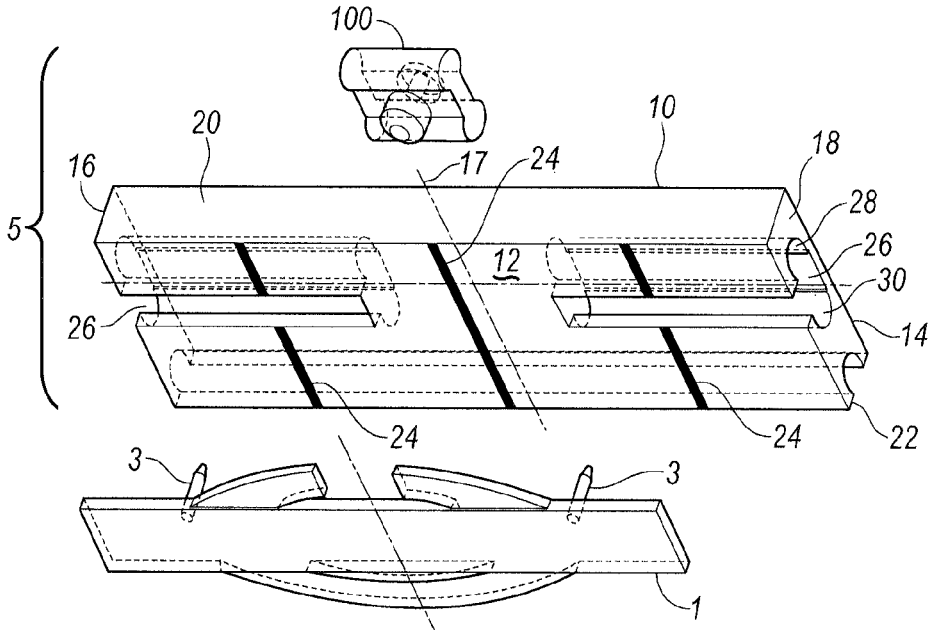
FIG. 3 is an exploded view of a badge and badge displaying device of the present invention.
Figure 3A:
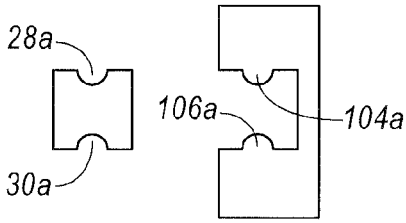
FIG. 3A is an alternate embodiment of the present invention.
Figure 6:
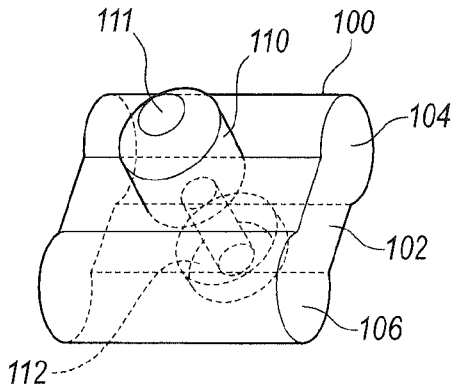
FIG. 6 is a top perspective view of a pin clip of the present invention.
Figure 7:
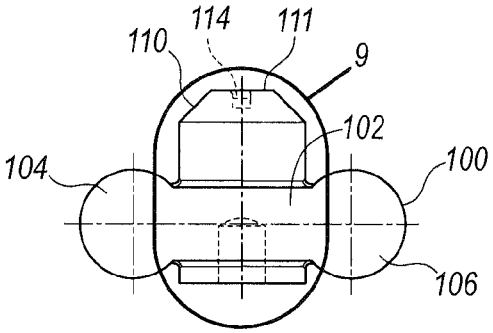
FIG. 7 is a right side view of a pin clip of the present invention.

The badge displaying device 5 also includes at least one pin clip 100 having central body portion 102 sized to fit into the slots 26. In FIGS. 6-7, the pin clip 100 is shown having two bulbous protrusions 104 106 sized to fit into the crevices 28, 30. However, just as the slots 26 may or may not have crevices 28, 30 the slot need not have protrusions 104 106. Further, it is within the scope of this invention to have the crevices may be located on the pin clip 100 and the protrusions may be located on the backing plate 10 as shown in FIG. 3A. The protrusions 104, 106 and crevices 28, 30 assist in securing the pin clip 100 in place relative to the backing plate 10. The particular shape of the protrusions 104, 106 and crevices 28, 30 is not important as long as the pin clip 100 mates with the slots 26 in the backing plate 10. Additionally, if the slot 26 in the backing plate 10 also extended through the bottom surface 14, the pin clip 100 may also comprise another protrusion sized to mate with the slot on the bottom surface 14 of the backing plate 10.

Figure 9:
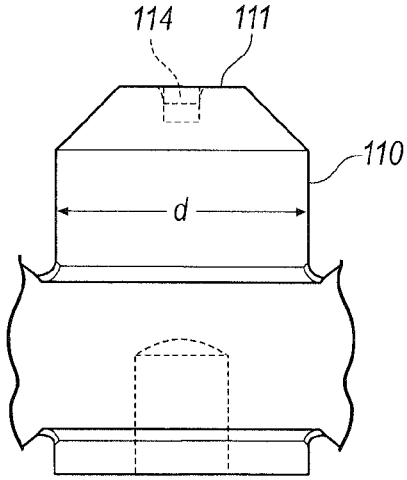
FIG. 9 is a side view of the retaining portion of the present invention.
Figure 8:
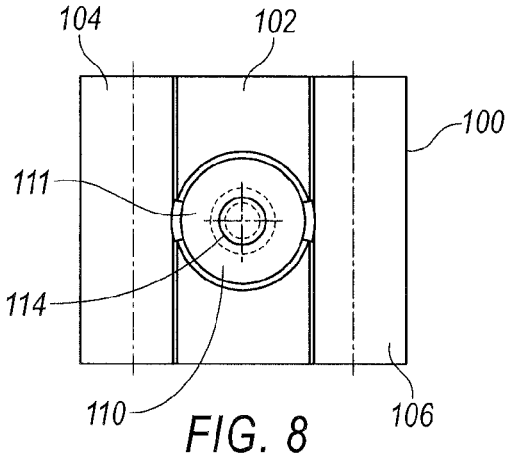
FIG. 8 is a top view of a pin clip of the present invention.

The pin clip 100 contains a receiving portion 110 to receive and secure a badge 1. The receiving portion 110 may be an integral portion of the body portion 102 or a separate component. FIG. 9 illustrates the preferred embodiment of a separate receiving portion 110 having a diameter d sized to fit into an opening 112 in the central body 102. A hole 114 may be provided in the tip 111 of the receiving portion 102 to locate and grab the pin 3 of the medal 1 when the pin 3 is inserted into the receiving portion 110. The particular shape of the receiving portion 110 and the opening 112 are not critical as long as the receiving portion 110 is secured to the body portion 102. Ideally, the opening 112 and the receiving portion 110 are sized accordingly such that no other material is needed to secure them, but adhesive or other securing methods and materials may also be used.

The pin clip 100 and the receiving portion can be manufactured out of nearly any type of material and process, but are preferably injection molded out of a thermoplastic rubber such as Santoprene® by Advanced Elastomer Systems.

In operation, pin clips 100 are inserted in the slots 26 of the backing plate 10 and aligned to the appropriate position using the alignment features 24 to accommodate the particular badge 1. Each badge 1 may have a different spacing between pins 3, but each type of badge should have a fairly consistent distance between the pins 3. The ability of the pin clips 100 to slide in the slots 26 will accommodate any variation.

The badge displaying device 5 is then properly positioned under the uniform (not shown) according to the relevant regulations using the backing plate 10 or other alignment features such as the tips 111 of the receiving portion 110. When positioned under a uniform, the tips 111 of the receiving portion 110 may create an impression on the outside of the uniform such that the user can properly locate the badge displaying device 5 and determine where to place the pins 3 of the badge 1. The badge 1 is then pressed towards the badge displaying device 5 and the pins 3 penetrate the receiving portion 110 thereby securing the badge 1 to the badge displaying device and to the uniform.

When additional badges 1 are awarded, the user obtains a second badge displaying device 5 appropriate for the particular badge 1. The badge displaying devices 5 are sized for the appropriate vertical spacing between the badges 1 which is covered in military regulations.

Figure 10:
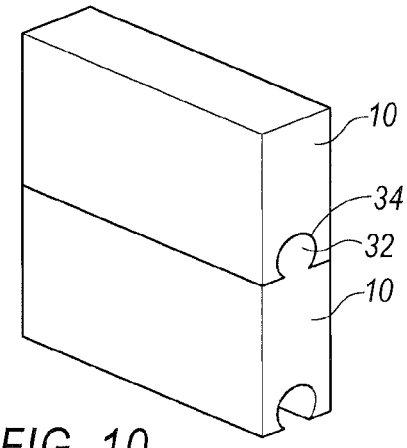
FIG. 10 is a perspective view of a badge displaying system of the present invention.

The first badge displaying device 5 contains either protrusion or crevices 32, 34 on the bottom side 22 of the backing plate 10 may be as shown in FIG. 1. The second badge displaying device 5 contains mating crevices or protrusions 32, 34 on the top side 20 as described above may be as shown in FIG. 4 or FIG. 5. As shown in FIG. 10, to secure the two badge displaying devices 5 together, the second badge displaying device 5 is slid onto or otherwise attached to the first badge displaying device 5. Alignment features 24 on the first and second badge displaying devices 5 can be aligned to create the proper horizontal alignment. As more badges 1 are awarded, additional badge displaying devices 5 can be attached as described above and the additional badges 1 will have the proper vertical spacing and horizontal alignment.

As the second or subsequent badge displaying devices 5 are added, the first badge securing device 5 can remain attached to the uniform or may be removed.

Unlike some of the prior art badge displaying devices, the present invention does not require a fastener to secure the badge 1 to the badge displaying device 5 or to the uniform. The thickness of the pin clip 100 and the backing plate 10 is preferably equal to or greater than a length on the pin 3 so nothing sticks out the bottom surface 14 of the backing plate 10. Unlike prior art devices, there is no fastener that may "dig into" a user causing discomfort or possibly damage other layers of clothing. The backing plate 10 may be made with rounded edges to increase comfort of the wearer and lessen the likelihood of damage to other layers of clothing.

The foregoing discussion is meant to be illustrative of the present invention, but not limiting in its scope. Rather, one of ordinary skill in the art would appreciate that many variations to the above described embodiments are possible without deviation from the spirit of the invention, and such variations should be deemed within the scope of the invention. Therefore, the invention is properly limited only by the plain and ordinary meaning of the words used in the claims appended below, as the inventor had not attempted to limit the scope of the invention in any manner in the foregoing discussion.

What is claimed as new and desired to be protected by Letters Patent of the United States is:

1. A badge displaying device comprising:

a backing plate having a left and right sides, a center between the left and right sides, and top and bottom surfaces, the backing plate having at least one slot through at least the top surface, the slot extending through the bottom surface and extending from one of the left or right sides towards the center of the backing plate; and a pin clip sized to slide in the at least one slot wherein the pin clip comprises a body portion and a receiving portion, the receiving portion protruding upwardly from the body portion.

2. The badge display of claim 1 wherein the backing plate has up and down sides and wherein the backing plate comprising at least one of a protrusion extending outwardly or crevice extending inwardly from one of the up or down sides.

3. The badge display of claim 1 wherein the receiving portion is made out of thermoplastic rubber.

4. The badge display of claim 1 wherein the backing plate has up and down sides and the backing plate further comprises a crevice between the top and bottom surfaces and extending towards one of the up or down sides and the pin clip has up and down sides and further comprises a protrusion extending from one of the up or bottom sides corresponding to the crevice of the backing plate such that the protrusion of the sliding pin clip slides in the crevice of the backing plate.

5. The badge display of claim 1 wherein the backing plate has up and down sides and the backing plate further comprises a protrusion between the top and bottom surfaces and extending towards one of the up or down sides and the pin clip has up and down sides and further comprises a crevice extending from one of the up and down sides corresponding to the protrusion of the backing plate such that the crevice of the sliding pin clip slides in the protrusion of the backing plate.

6. The badge display of claim 1 wherein the backing plate has up and down sides and the backing plate further comprises two crevices between the top and bottom surfaces and each crevice extending respectively towards one of the top or sides and the pin clip has up and down sides and further comprises two protrusions extending respectively from the top and bottom sides corresponding to the crevices of the backing plate such that the protrusions of the sliding pin clip slide in the crevices of the backing plate.

7. The badge display of claim 1 further comprising alignment markings on the backing plate to assist in aligning the pin clip.

8. The badge display of claim 1 further comprising a second slot extending at least through the upper surface and extending from the other of the left or right sides towards the center of the backing plate and a second pin clip sized to slide in the second slot.

9. A badge displaying device for displaying medals or ribbons, the badge displaying device comprising:

a backing plate having left and right sides, a center between the left and right sides, and top and bottom surfaces, the backing plate having two slots through at least the top surface, the two slots extending through the bottom surface and extending respectively from the left and right sides towards the center of the backing plate; and two pin clips sized to slide into the slots, the pin clip comprising a body portion and a receiving portion.

10. The badge display of claim 9 wherein the backing plate has up and down sides and wherein the backing plate comprising at least one of a protrusion extending outwardly or crevice extending inwardly from one of the up or down sides.

11. The badge display of claim 9 wherein the backing plate has up and down sides and the backing plate further comprises a crevice between the top and bottom surfaces and extending towards one of the up or down sides and the pin clip has up and down sides and further comprises a protrusion extending from one of the up or bottom sides corresponding to the crevice of the backing plate such that the protrusion of the sliding pin clip slides in the crevice of the backing plate.

12. The badge display of claim 9 wherein the backing plate has up and down sides and the backing plate further comprises a protrusion between the top and bottom surfaces and extending towards one of the up or down sides and the pin clip has up and down sides and further comprises a crevice extending from one of the up and down sides corresponding to the protrusion of the backing plate such that the crevice of the sliding pin clip slides in the protrusion of the backing plate.

13. The badge display of claim 9 wherein the backing plate has up and down sides and the backing plate further comprises two crevices between the top and bottom surfaces and each crevice extending respectively towards one of the top or sides and the pin clip has up and down sides and further comprises two protrusions extending respectively from the top and bottom sides corresponding to the crevices of the backing plate such that the protrusions of the sliding pin clip slide in the crevices of the backing plate.

14. A badge displaying system comprising:

a first backing plate having up and down sides, left and right sides and top and bottom surfaces, the backing plate having at least one slot through at least the top surface extending from a side towards the center of the backing plate and a pin clip sized to slide in the slot and wherein the backing plate comprising one of a protrusion extending outwardly or crevice extending inwardly from the down side; and a second plate having up and down sides, left and right sides and top and bottom surfaces, the backing plate having at least one slot through at least the top surface extending from a side towards the center of the backing plate and a pin clip sized to slide in the slot and wherein the backing plate comprising one of a protrusion extending outwardly or crevice extending inwardly from the up side sized to receive the one of a protrusion extending outwardly or crevice extending inwardly from the down side of the first backing plate such that the first and second backing plates are retained together.

15. The badge display system of claim 14 further wherein each of the first and second backing plates comprise a second slot extending at least through the upper surface and extending from the other of the left or right sides towards the center of the backing plate and a second pin clip sized to slide in the second slot.

16. The badge display system of claim 14 wherein each of the first and second backing plates further comprise two crevices between the top and bottom surfaces and each crevice extending respectively towards one of the top or sides and the pin clip has up and down sides and further comprises two protrusions extending respectively from the top and bottom sides corresponding to the crevices of the backing plate such that the protrusions of the sliding pin clip slide in the crevices of the backing plates.

* * * * *